US008939292B2

(12) United States Patent
Doppstadt et al.

(10) Patent No.: US 8,939,292 B2
(45) Date of Patent: Jan. 27, 2015

(54) SCREEN MACHINE, IN PARTICULAR STAR SCREEN MACHINE

(75) Inventors: Johan Doppstadt, Velbert (DE); Horst Berger, Calbe (DE)

(73) Assignee: Doppstadt Familienholding GmbH, Velbert (DE)

( * ) Notice: Subject to any disclaimer, the term of this patent is extended or adjusted under 35 U.S.C. 154(b) by 88 days.

(21) Appl. No.: 13/390,144

(22) PCT Filed: Apr. 16, 2010

(86) PCT No.: PCT/EP2010/002351

§ 371 (c)(1),
(2), (4) Date: Feb. 13, 2012

(87) PCT Pub. No.: WO2010/127763

PCT Pub. Date: Nov. 11, 2010

(65) Prior Publication Data

US 2012/0228198 A1 Sep. 13, 2012

(30) Foreign Application Priority Data

May 7, 2009 (DE) ..... 20 2009 006 561 U
Aug. 13, 2009 (DE) ..... 20 2009 010 983 U

(51) Int. Cl.

| | |
|---|---|
| ***B07B 1/15*** | (2006.01) |
| ***B07B 13/00*** | (2006.01) |
| ***B07B 1/14*** | (2006.01) |
| ***B07B 9/00*** | (2006.01) |

(52) U.S. Cl.

CPC ... *B07B 1/14* (2013.01); *B07B 1/15* (2013.01); *B07B 9/00* (2013.01)

USPC ..... 209/254; 209/669; 209/672; 209/243

(58) Field of Classification Search

USPC ..... 209/669, 672, 243, 667, 671, 254, 283, 209/293, 304

See application file for complete search history.

(56) References Cited

U.S. PATENT DOCUMENTS

| | | | | |
|---|---|---|---|---|
| 3,217,346 | A * | 11/1965 | Silver et al. | 15/3.11 |
| 4,068,991 | A * | 1/1978 | Ufermann et al. | 425/81.1 |
| 4,430,210 | A * | 2/1984 | Tuuha | 209/234 |
| 4,755,286 | A * | 7/1988 | Bielagus | 209/243 |
| 5,098,341 | A * | 3/1992 | Kuchar | 460/99 |
| 5,298,119 | A * | 3/1994 | Brown | 162/55 |
| 5,887,515 | A * | 3/1999 | Kunstmann et al. | 100/39 |
| 6,375,565 | B1 * | 4/2002 | Tanner et al. | 460/123 |
| 7,677,397 | B2 * | 3/2010 | Bjornson et al. | 209/672 |
| 7,882,958 | B2 * | 2/2011 | Doppstadt et al. | 209/245 |
| 8,136,672 | B2 * | 3/2012 | Bjornson et al. | 209/672 |
| 2006/0163120 | A1 * | 7/2006 | Doppstadt et al. | 209/284 |

FOREIGN PATENT DOCUMENTS

| | | |
|---|---|---|
| DE | 30 24 046 | 2/1981 |
| DE | 89 06 721 | 8/1989 |

(Continued)

*Primary Examiner* — Patrick Cicchino

(74) *Attorney, Agent, or Firm* — Jacobson Holman, PLLC.

(57) ABSTRACT

The invention refers to a screening machine, in particular a star screening machine, comprising at least two driven shafts provided with stars and/or discs, the shafts being arranged in a screening plane parallel spaced to each other, wherein the stars and/or discs are provided on different shafts staggered or comb-like engaging with each other, with a hopper or filling area in which the material to be screened can be filled. Wherein on the side facing the filling area in a plane above the screening plane and spaced parallel from it two distribution devices are provided one after the other in the direction of screening or conveying for distributing the material to be screened on the screening plane.

14 Claims, 7 Drawing Sheets

(56) References Cited

FOREIGN PATENT DOCUMENTS

Figure 1A:
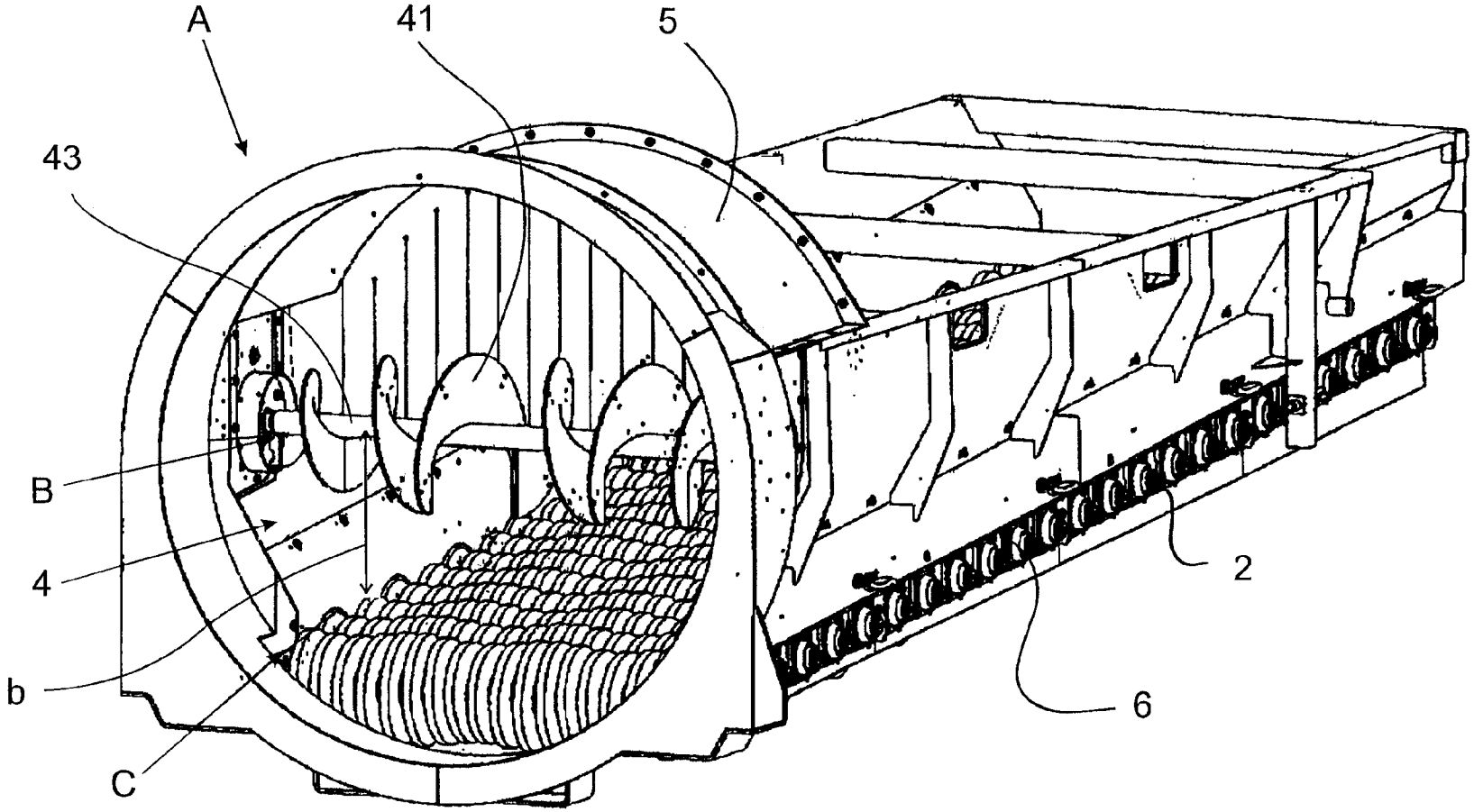

| | | |
|---|---|---|
| DE | 197 41 762 | 3/1999 |
| DE | 198 57 498 | 6/2000 |
| DE | 600 17 535 | 3/2006 |
| EP | 1 614 340 | 1/2006 |
| FR | 580 260 | 11/1924 |
| GB | 819499 | 9/1959 |

* cited by examiner

SCREEN MACHINE, IN PARTICULAR STAR SCREEN MACHINE

This is a national stage of PCT/EP10/002351 filed Apr. 16, 2010 and published in German, which claims the priority of German number 10 2009 006 561.8 filed May 7, 2009, and German number 10 2009 010 983.6 filed Aug. 13, 2009, hereby incorporated by reference.

The invention refers to a screening machine, in particular star screening machine, comprising at least two driven shafts provided with stars and/or discs, the shafts being arranged in a screening plane spaced parallel to each other, wherein the stars and/or discs are provided on different shafts staggered to each other or comb-like engaging, with a hopper or filling area in which the material to be screened can be filled.

Screening machines of this type, for example disc or star screening machines, are sufficiently known in the state of the art. The screening stars or discs are arranged in a screening plane, and that is on shafts, and form here a screening plane defined by the surface or the external diameter of the stars or discs. The problem with screening machines of this type is, that in particular if fibrous, moist and sticky screening material is filled in the hopper, this material is spread very uneven on the screening plane. The result is, that the stars screens or disc screens clog rather fast, and are in particular prone to conglutinations. If the material is very fibrous this may lead to a considerable reduction of the screening effect. The fibers are prone to stick between the discs or stars what reduces the screening effect considerably.

Referring to this state of the art it is a problem of the invention to suggest a screening machine, in particular a star screening machine that does not have anymore the described disadvantages.

The problem of the invention is solved by a screening machine, in particular star screening machine, comprising at least two driven shafts provided with stars and/or discs, the shafts being arranged in a screening plane spaced parallel to each other, wherein the stars and/or discs are provided staggered to each other on the different shafts, or comb-like engaging with each other, with a hopper or filling area in which the material to be screened can be filled, that is characterized in that on the side facing the filling area in a plane above the screening plane and spaced parallel from it, two distribution devices (4) one after the other in the direction of screening or conveying for spreading the material to be screened on the screening plane.

The problem of the invention is also solved by a screening machine, in particular star screening machine comprising at least two driven shafts provided with stars and/or discs, the shafts being arranged in a screening plane spaced parallel to each other, wherein the stars and/or the discs are provided on the different shafts staggered or comb-like engaging to each other, with a hopper or filling area in which the material to be screened can be filled, wherein on the side facing the filling area in a plane above the screening plane and spaced parallel from it at least one distribution device for distributing the material to be screened on the screening plane is provided, that is characterized in that at the diameter of the distribution device distributing elements are arranged worm-like, provided with at least two different, in particular opposed inclines.

These configurations according to the invention now make it possible that the filled-in screening material is distributed in particular at the beginning of the screening plane or screening surface such that the screening material is distributed evenly to the single discs or stars, and thus the screening effect is clearly improved. Accordingly, this distribution device takes care of drawing apart and distributing certain lumps and fibrous agglomerations evenly on the plane. In particular the material to be screened is loosened. The star screening machine then screens the material to be screened very evenly, and in particular a machine of this type is not prone to conglutinations and cloggings. Accordingly, the disadvantages of the state of the art are completely removed by the solution according to the invention.

A development of the first mentioned embodiment of the screening machine according to the invention provides, that the two distributing devices can be driven rotatably and with opposite rotational direction. This improves further the distributing effect.

According to an advantageous configuration, the screening machine is characterized in that the distributing device is configured as cylinder or barrel provided with distributing elements, or as worm supported by means of a worm shaft, that has essentially the same width as the screening plane. A worm of this type has the advantage that the material to be screened can be spread very effective on the screening surface or screening plane. The worm additionally effects, that the screening material is loosened and that certain cloggings are removed by the rotatably supported worm.

It is an advantage if the worm has at least two opposite arranged inclines. These make it possible to spread the material to be screened even more effectively and evenly on the screening surface or screening plane.

Furthermore, it is an advantage, if the worm is arranged in a housing. It is also an advantage, if the worm has, originating at its center to the outside, incline areas facing away from the center, and inclines in the opposite direction facing from the edge area inwards to the center. This reaches an even more effective and even distribution of the screening material.

In order to be able to react on different materials to be screened it is convenient, if the distance of the worm to the screening plane can be adjusted. Furthermore, it is provided according to the invention, that the rotational direction and/or the rotational speed of the worm can be adjusted. Thus it is possible, for example by an adjustment of the rotational speed or rotational direction, to remove certain agglomerations or cloggings very easily without impairing the screening function of the star screen or disc screen.

In order to increase the effect of the material distribution it is provided, according to a development of the invention, that at the worm tappets can be arranged, that at least support an equalization of the material. This can be done, for example, in the form of pins that can be inserted in bore holes provided at the circumference of the shaft.

The screening machine according to the invention is characterized also in that the distance of the shafts to one another can be changed. Thus it is possible to use different screening stars, i.e. screening stars with different diameters, or also different discs.

Another aspect of the screening machine according to the invention is characterized in that at least two shafts each are arranged cassette-like at a frame. Thus it is determined, that for example two, three or six shafts are provided with corresponding screening stars or screening discs, and these can be arranged cassette-like in the screening plane.

By means of this, the screening surface can be enlarged at will. An effect is, in particular, that cassettes can be provided with differently equipped screening stars and/or discs. These shafts can also run with suitably other rotational speeds, or even in opposite direction, if this proves necessary because of the material to be screened. Accordingly, the screening plane can be assembled by single frames carrying shafts as cassettes, in particular module-like or in the way of a building block system.

It is also advantageous when the shafts can be exchanged.

In order to further increase the function of exchanging the shafts, the shafts are attached to the frames by pegs, bolts or quick clamping devices or the like. This makes a very fast and easy exchange of the single shafts possible. For example, damaged screening stars can be exchanged without hurry in the shop, when a spare shaft is inserted without any problems. The standstill times of the machine are thus reduced. Of course, it is also provided according to the invention, that the number of shafts at the frames or cassettes can be varied.

As already mentioned, an advantageous embodiment of the invention is characterized in that the shafts of the single cassettes can be driven with different rotational speed and different rotational direction. It is also an advantage, if the number, size and distance of the stars and/or discs to one another on the shafts can vary.

For the design of a screening machine as disc screen it is provided, according to an embodiment of the invention, that at least one disc is designed as a polygon differing from the circular shape. Of course, the invention also suggests, that the stars or discs are designed such that they can be exchanged, in particular can be slid or slipped on the shaft. The invention furthermore suggests providing spacers that can be slid or slipped on the shaft between the stars, and that are held on the shaft by means of a clamping device.

Of course, the invention also suggests a recycling and sorting or screening plant, respectively, with at least one screening machine according to one of the previously described modifications.

In the following the invention is described further by means of examples.

Figure 1B:
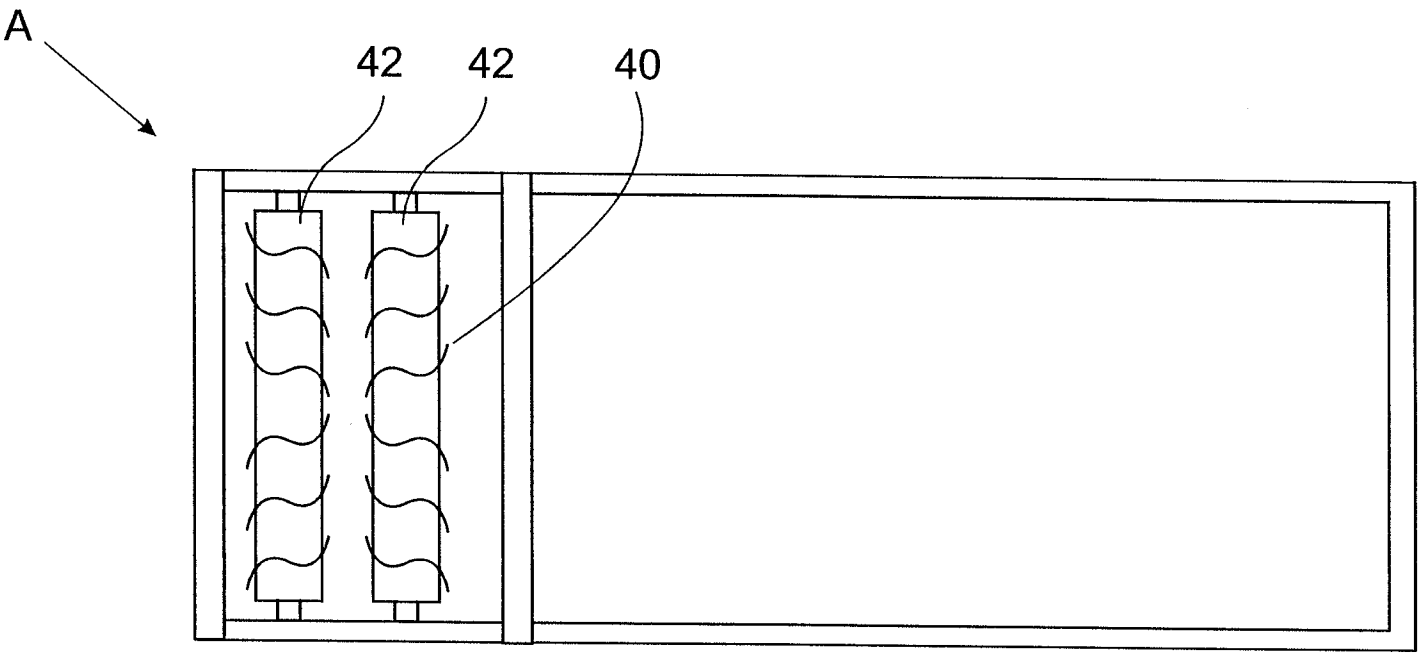
Figure 2:
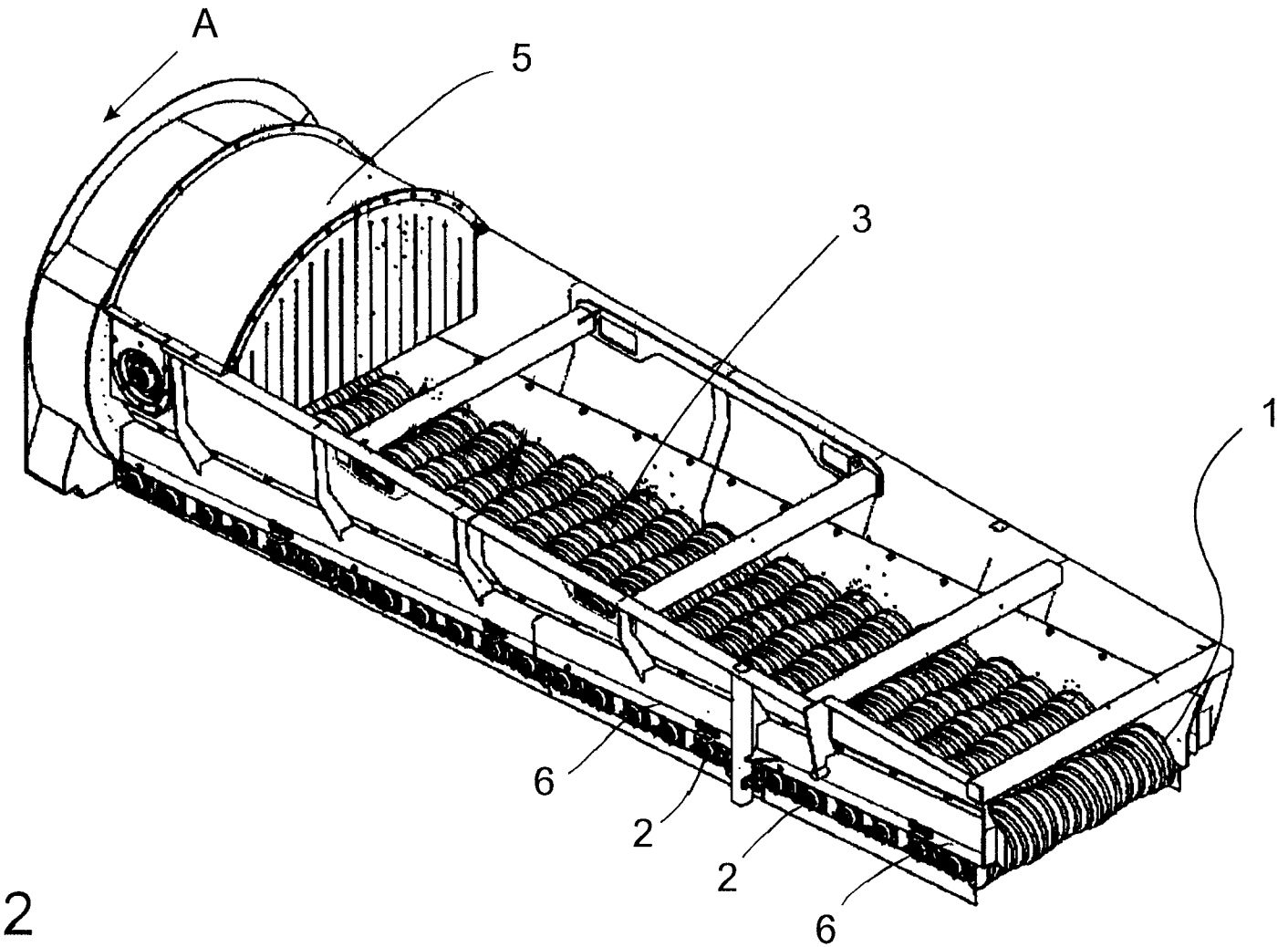
Figure 3:
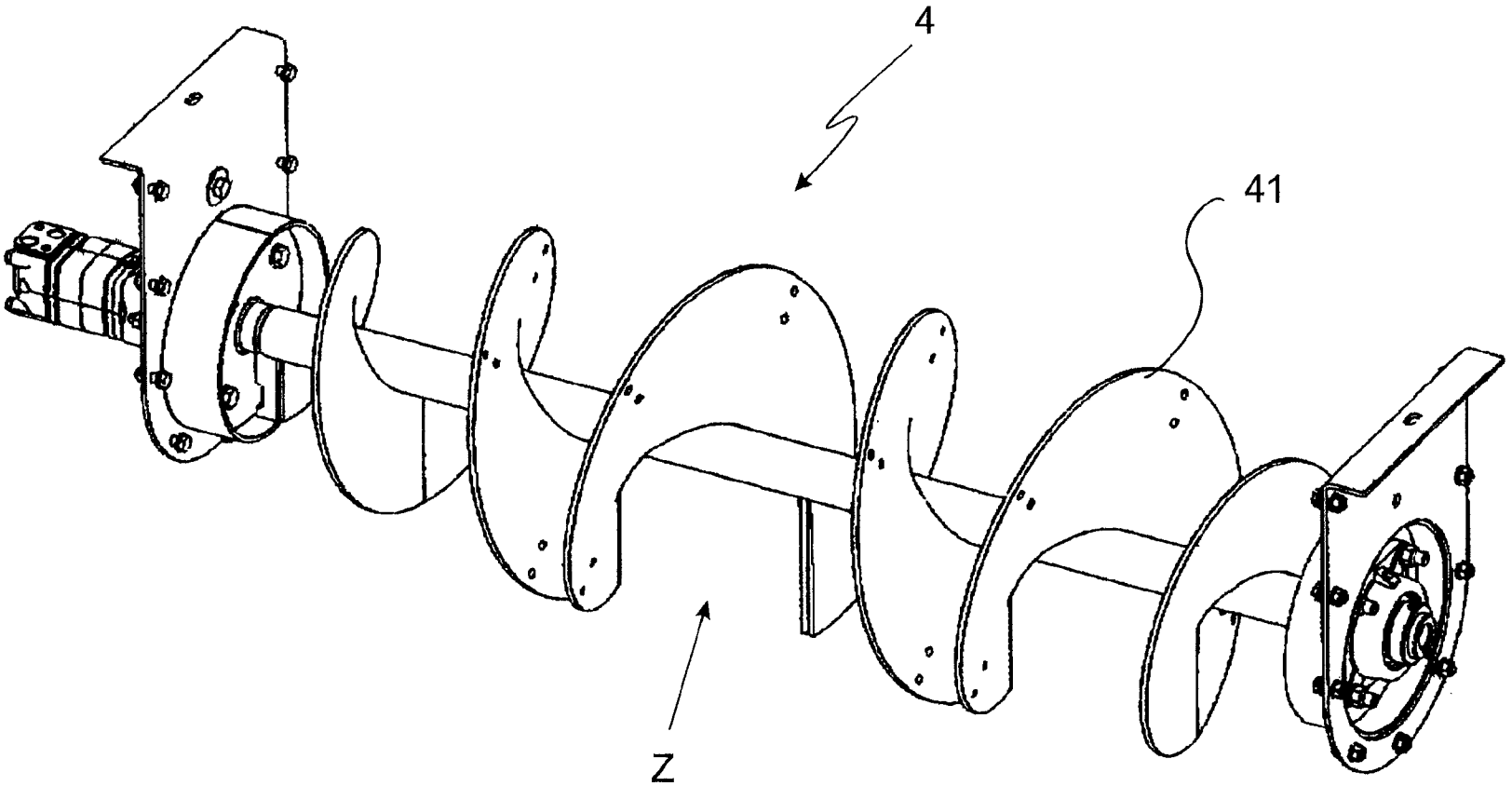
Figure 4:
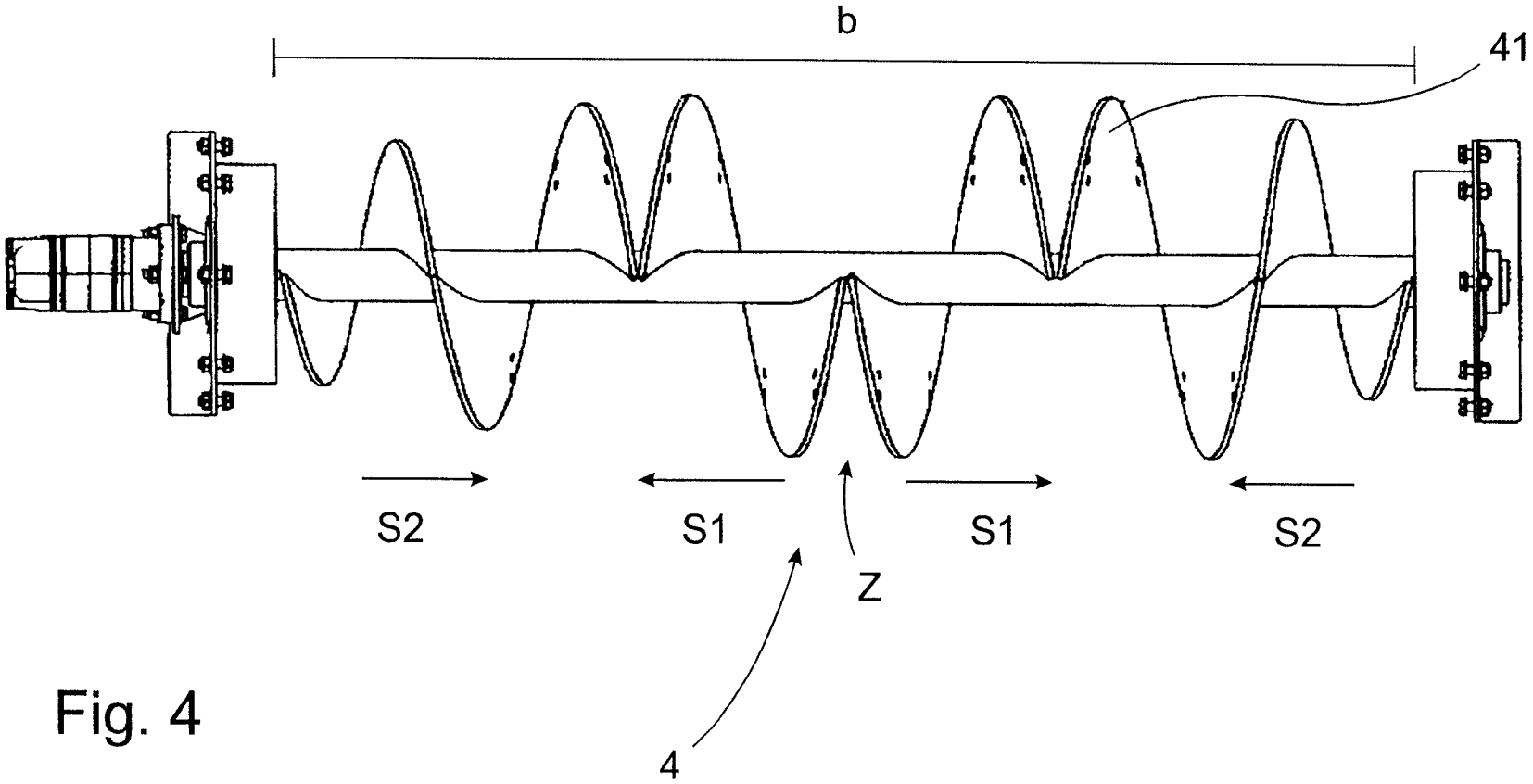
Figure 5:
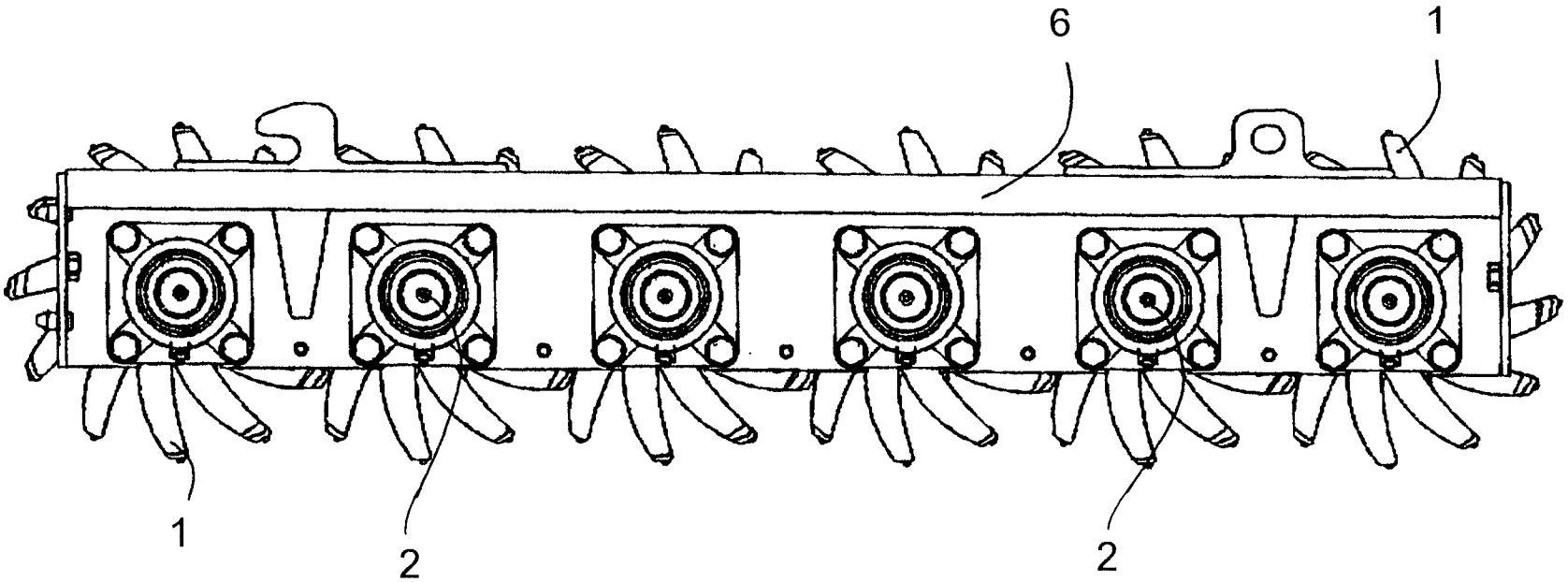
Figure 6:
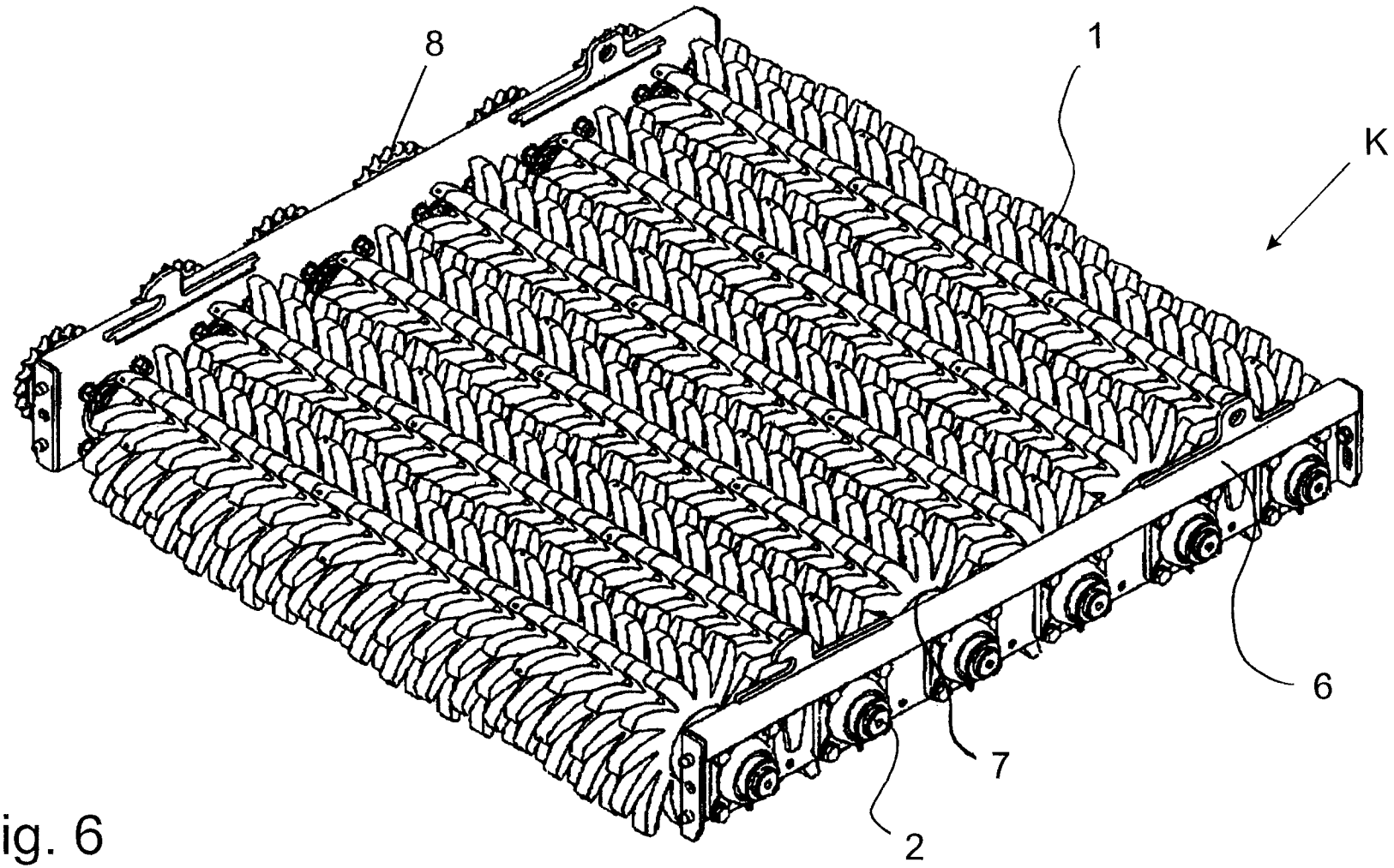

In the figures:

FIG. 1*a* in a three-dimensional view an embodiment of the screening machine according to the invention, FIG. 1*b* a top view with schematic representation of two distribution devices, FIG. 2 view of FIG. 1*a* from another point of view, FIG. 3 an embodiment of a worm for the screening device according to the invention, FIG. 4 another embodiment of the worm for the screening device according to the invention, FIG. 5 side view of a screening device as star screening machine and FIG. 6 module of a star screening machine with frame and six shafts.

In the following, the figures will be described in combination. Identical reference numbers are here used in the same way in all figures. For this reason it is not necessary to present them every time in the single figures anew.

FIG. 1*a* and FIG. 2 show a screening machine according to the invention in a three-dimensional view, wherein FIG. 1*a* shows the view where the distribution device 4 with a rotationally supported worm 41 is shown. The worm 41 supported rotationally on a worm shaft 43 is provided in a housing 5 that is provided in the entrance area or the area A facing the filling area. In this figure the filling area or the hopper cannot be seen because of the sectional view in order to make the worm 41 visible. The single discs or screening stars are arranged on shafts 2, that are supported by a frame 6. The single screening discs or screening stars are referred to by reference number 3. The screening plane C indicates the plane above the discs 3. The double arrow indicates the distance b of the screening plane C to the plane B in which the distribution device 4 is arranged. As it can be seen, this distance b can be changed or adjusted.

FIG. 2 shows the same star or disc screening machine from another point of view. It can be clearly seen here that the distribution device 4 is arranged protected in the housing 5. The area indicated by A is the area facing the filling area.

FIG. 1*b* shows a top view with schematic representation of two distribution devices 4 that are arranged spaced from each other, in particular spaced parallel to each other, in the entrance area. The distribution devices 4 are in this embodiment cylinders 42 or barrels equipped with distribution elements 40 that have essentially the same width as the screening plane C. The invention also comprises here if instead of the cylinders 42 two worms 41 are provided.

FIG. 3 shows a particular embodiment of the distribution device 4 according to the invention. The distribution device is here provided as worm 41, where it can be seen that the worm 41 has differently extending worm helixes, and this is such that the inclines S1 extend outward from the center Z. On the side of the edge the incline S2 is exactly vice versa, so that it becomes possible through this embodiment to reach a very even distribution of the material to be screened on the screening plane C.

In FIG. 4 this vice versa configuration of the worm helix can be seen very clearly.

FIG. 5 shows a frame for a module like construction of the screening plane. The frame is indicated by reference number 6. The other reference numbers have already been presented.

In FIG. 6 a module with screening stars and six shafts is shown that can be part of a screening plane C for a screening machine according to the invention.

The invention claimed is:

1. A screening machine for screening fibrous, moist and sticky screening material, in particular star screening machine, comprising at least two driven shafts provided with stars or discs, the shafts being arranged in a screening plane spaced parallel to each other, wherein the stars or discs are provided on different shafts staggered or comb-like engaging with each other, with a hopper or filling area in which the fibrous, moist and sticky screening material to be screened can be filled, wherein on a side facing the filling area in a plane above the screening plane and spaced parallel from the screening plane, at least one distribution device is provided for distributing the material to be screened on the screening plane, wherein the at least one distribution device is configured as cylinder or barrel or as worm, rotatable by means of a shaft provided with distribution elements and the distribution elements with more than two different inclines are provided at the circumference of the distribution device; wherein adjacent inclines work in opposite directions.

2. The screening machine according to claim 1, wherein the at least one distribution device are two distribution devices arranged one after the other in the direction of screening and the two distribution devices are rotatable and are driven with a rotational direction in opposite direction.

3. The screening machine according to claim 1, wherein the distribution elements has essentially the same width as the screening plane.

4. The screening machine according to claim 1, wherein when the distribution device is configured as worm, the worm has at least two inclines working in opposite direction, or the worm is arranged in a housing.

5. The screening machine according to claim 1, wherein when the distribution device is configured as worm, starting from a center of the worm this has inclines facing outwards, away from the center and inclines facing inwards from the edge area to the center working in opposite direction.

6. The screening machine according to claim 1, wherein when the distribution device is configured as worm, the distance of the worm to the screening plane can change, or the rotational direction or number of revolutions of the worm can change.

7. The screening machine according to claim 1, wherein when the distribution device is configured as worm, at worm tappets can be arranged that at least support equalization of the material, or at least two shafts are provided and the distance of the shafts to one another can change.

8. The screening machine according to claim 1, wherein at least one frame is provided and at least two shafts are provided and each time at least two shafts are arranged cassette-shape at frames, or the screening plane is formed by single shaft-bearing frames as cassettes or can be assembled in the way of a building block system.

9. The screening machine according to claim 1, wherein at least two shafts are provided and the shafts are configured exchangeable, or the shafts are attached by means of pegs, bolts, quick clamping devices to the frame.

10. The screening machine according to claim 8, wherein the number of shafts at the frames or cassettes can vary, or the shafts of the single cassettes can be driven with different number of revolutions and different rotational direction.

11. The screening machine according to claim 1, wherein the number, size and the distance of the stars or discs to one another on the shafts can vary.

12. The screening machine according to claim 1, wherein at least one of the discs is configured as a polygon deviating from the circular form, or the stars or discs can be exchanged, slid or pushed on the shaft.

13. The screening machine according to claim 1, wherein spacers are provided that can be slid or pushed on the shaft between the stars, and that are held on the shaft by a clamping device.

14. A recycling or sorting plant with at least one screening machine according to claim 1.

* * * * *